United States Patent [19]

Berger et al.

[11] 4,452,051

[45] Jun. 5, 1984

[54] MODULAR COLD GENERATING APPARATUS

[75] Inventors: Raymond Berger, Grenoble; Maurice de Cachard, La Tronche; André Gouzy, St-Ismier; Félix Trombe, Paris, all of France

[73] Assignee: Commissariat a l'Energie Atomique, Paris, France

[21] Appl. No.: 296,194

[22] Filed: Aug. 25, 1981

[30] Foreign Application Priority Data

Aug. 27, 1980 [FR] France ..... 80 18582

[51] Int. Cl.[3] ..... F28D 21/00; F25B 23/00; F25D 11/00

[52] U.S. Cl. ..... 62/467; 165/104.11; 165/DIG. 6; 62/DIG. 1; 62/430

[58] Field of Search ..... 165/47, 104.11, 10, 165/DIG. 6, 104.21; 62/467 R, DIG. 1, 430

[56] References Cited

U.S. PATENT DOCUMENTS

| | | | |
|---|---|---|---|
| 2,105,751 | 1/1938 | Money | 165/86 X |
| 2,289,809 | 7/1942 | Sherwood | 165/DIG. 6 |
| 2,396,338 | 3/1946 | Newton | 165/DIG. 6 |
| 3,035,419 | 5/1962 | Wigert | 165/104.33 X |
| 3,100,969 | 8/1963 | Elfving | 165/104.21 X |
| 3,209,062 | 9/1965 | Scholz | 165/104.33 X |
| 3,828,845 | 8/1974 | Waters | 165/104.21 X |
| 4,073,284 | 2/1978 | Laing | 62/467 R X |

*Primary Examiner*—Albert W. Davis, Jr.

*Attorney, Agent, or Firm*—Kerkam, Stowell, Kondracki & Clarke

[57] ABSTRACT

Cold generating apparatus, wherein it comprises a cold storage enclosure filled with a material having a solid-liquid transmission in the vicinity of the operating temperature of the apparatus, a first panel forming a radiating surface, whose radiation drops into at least one of the atmospheric windows, a substantially vertical second panel immersed in the material of the cold storage enclosure, a pipe in the form of a coil on each of the first and second panels, said pipes being connected by plastically deformable couplings to form a closed circuit and a certain quantity of a fluid which is vaporizable under the operating conditions of the apparatus within the closed circuit, the assembly constituted by the first and second panels, the closed circuit and the heat transfer fluid forming a device of the heat pipe type serving as a thermal diode which only transmits heat in the direction from the storage enclosure to the radiating surface.

4 Claims, 4 Drawing Figures

MODULAR COLD GENERATING APPARATUS

BACKGROUND OF THE INVENTION

The present invention relates to a modular cold generating apparatus.

The prior art disclosed cold generating apparatus operating in an autonomous manner, i.e. without any external energy supply and having no moving part. Thus, they are characterized by a high degree of simplicity and excellent reliability. Such apparatus are based on the known property of the earth's atmosphere of permitting the passage in a preferred manner of radiation between 8 and 13$\mu$ and between 16 and 25$\mu$. Part of the radiation emitted by black bodies falls within the above ranges.

It is known that a black body is a body which completely absorbs the radiation which it receives, no matter what its wavelength. Such a body is in thermodynamic equilibrium with the radiation which it receives and with the radiation which it emits. In principle, the emissivity of a black body is equal to unity and extends throughout the spectrum, particularly in the atmospheric windows. When a black body is placed in the atmosphere, the energy portion which it radiates in such windows is transmitted into space, almost without accumulation. This leads to a cooling of the emitting body. The temperature drop undergone by the body is limited if parasitic heat exchanges take place with the ambient air or with the ground either by convection, or via condensation phenomena linked with the degree of humidity of the air.

In known cold generating apparatus, the body undergoing cooling due to its radiation through atmospheric windows is thermally linked with a material have a solid—liquid transition in the vicinity of the operating temperature of the apparatus. This thermal link takes place by means of a heat pipe, which acts as a thermal diode, ensuring the thermal connection only in the direction from the material to the black body. This leads to a reduction in the temperature of the material causing its solidification, without any reverse transformation of the solid phase to the liquid phase taking place, because the transfer of heat which could take place from the radiating body is blocked by the thermal diode. Thus, the apparatus produces cold and stores it.

FIG. 1 shows such a known cold generation apparatus. This apparatus comprises a radiating surface 2 connected thermally with a heat pipe 4 constituting a thermal diode. The lower part 6 of the heat duct is provided with ribs 8, which serve to increase the exchange surface betwen the fusible material and the heat pipe. It is immersed within a fusible material which is liquid at the daytime ambient temperature, e.g. water, said reservoir being thermally insulated from the ground and is tightly sealed by means of its walls, which are e.g. made from a plastics material. This storage reservoir is not shown in FIG. 1.

In its upper part, the heat pipe 4 has a discontinuous capillary structure enabling it to perform the function of a thermal diode. When the radiating surface is at a temperature above that of the storage reservoir, the condensed liquid of the heat duct remains in the bottom part thereof and it is impossible for heat to be transferred by the heat pipe.

The heat pipe is filled with a compound, whose evaporation point is compatible with the operating temperature of the apparatus, e.g. freon or ammonia.

However, the aforementioned cold generating apparatus has a certain number of disadvantages. The construction of the heat pipe or pipes ensuring the thermal connection between the cold storage means and the radiating surface is of a complex nature, leading to high manufacturing costs. The fins operate under thermal conduction conditions, so that they do not have a very good efficiency. Thus, the thermal connection between the storage material and the heat duct 4 is relatively poor.

In addition, the radiating surface 2 also functions under thermal conduction conditions. Therefore, the thermal connection between the radiation surface and the heat duct is also relatively poor.

Finally, such apparatus have significant overall dimensions, similar to that of an open umbrella. Therefore, they are not very suitable for transportation. When it is necessary to transport a large number of such apparatus over long distances, the transportation costs are very high.

BRIEF SUMMARY OF THE INVENTION

The present invention relates to a cold generation apparatus obviating the disadvantages of the prior art apparatus. It simplifies the construction thereof, considerably increases the thermal efficiency and in particular reduces the overall dimensions for transportation purposes. As a result, the manufacturing, transportation and installation costs are significantly reduced.

The present invention therefore relates to a cold generating apparatus wherein it comprises a cold storage enclosure filled with a material having a solid-liquid transition in the vicinity of the operating temperature of the apparatus, a first panel forming a radiating surface, whose radiation drops into at least one of the atmospheric windows, a substantially vertical second panel immersed in the material of the cold storage enclosure, a pipe in the form of a coil on each of the first and second panels, said pipes being connected by plastically deformable couplings to form a closed circuit and a certain quantity of a fluid which is vaporizable under the operating conditions of the apparatus within the closed circuit, the assembly constituted by the first and second panels, the closed circuit and the heat transfer fluid forming a device of the heat pipe type serving as a thermal diode which only transmits heat in the direction from the storage enclosure to the radiating surface.

Preferably, the couplings between the coil-like pipes formed on each of the panels, one for the discharge of steam to the condenser and the other for the return of liquid to the evaporator, are made from annealed metal, e.g. of copper or aluminum. This makes it possible to fold and unfold the assembly a certain number of times without any risk of leaks or fractures.

According to a preferred embodiment of the invention, the assembly constituted by the radiating surface, the second panel forming the evaporator and the closed circuit is formed by a single panel which is perforated in its central part in order to define an upper panel forming the radiating surface and a lower panel forming the evaporator.

BRIEF DESCRIPTION OF THE DRAWINGS

The invention will be described in greater detail hereinafter relative to non-limitative embodiments and the attached drawings, following on the drawing already described, and wherein show.

DETAILED DESCRIPTION OF THE PREFERRED EMBODIMENTS

Figure 1:
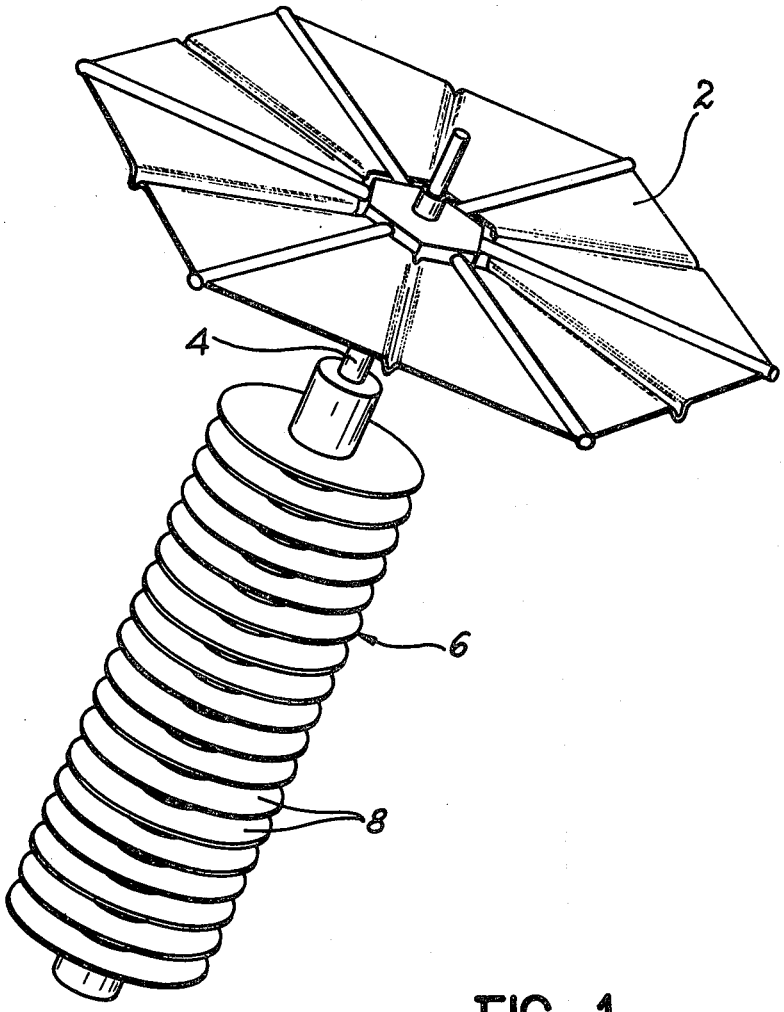
FIG. 1 (PRIOR ART)
FIG. 1 shows a known form of cold generating apparatus.
Figure 2:
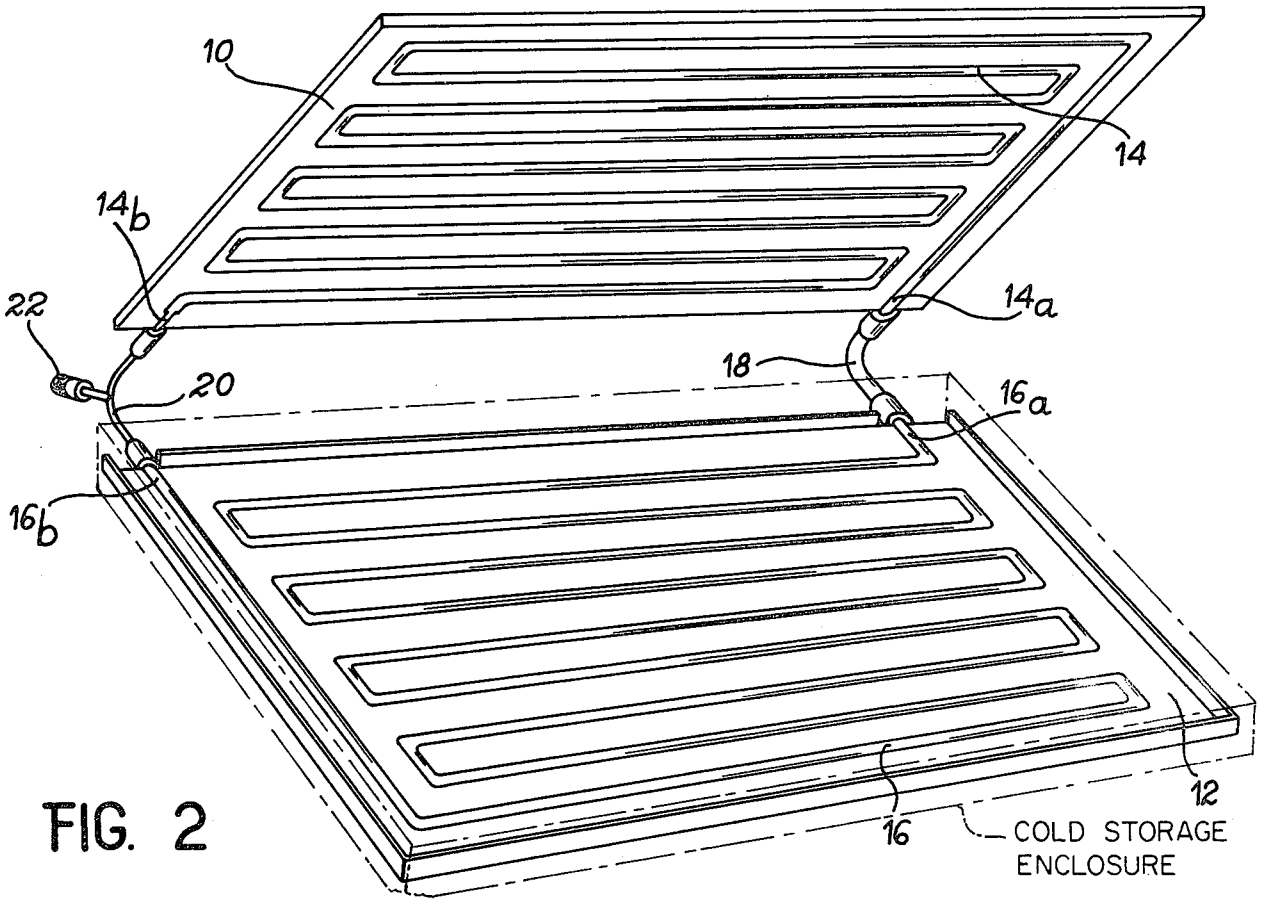
FIGS. 2 and 3 two constructional variants of the cold generating apparatus according to the invention.

FIG. 2 shows a first embodiment of the cold generation apparatus according to the invention. The apparatus comprises a first panel 10 forming a radiating surface, whose radiation drops in at least one atmospheric window, as well as a second panel 12 which is substantially vertically immersed in the material of the storage enclosure. A coil-like pipe 14 is formed on panel 10. A pipe 16, substantially identical to pipe 14 is formed on panel 12. The end 14*a* of pipe 14 is connected to end 16*a* of pipe 16 by a coupling 18. In the same way, end 14*b* of pipe 14 is connected to end 16*b* of pipe 16 by a coupling 20. Coupling 20 has a filling end fitting 22 via which a certain quantity of a heat transfer fluid is introduced into the closed circuit constituted by pipes 14 and 16 and by couplings 18 and 20. This heat transfer fluid, e.g. freon or ammonia is vaporizable under the operating conditions of the apparatus. Manifold 18 is used for the discharge of steam to the condenser, whilst manifold 20 is used for the return of the heat transfer fluid to the evaporator.

In this way, a device of the heat pipe type is formed, which acts as a thermal diode operating in the following way. When as a result of its radiation through atmospheric windows, the panel 10 operating as a radiating surface undergoes cooling, a heat transfer occurs by heat duct action of panel 12 towards radiating surface 10 and consequently towards the atmosphere. A certain quantity of heat transfer fluid vaporizes within evaporator panel 12. The thus formed vapor is displaced by pipe 16, then by coupling 18 up to the colder panel 10, which serves as a condenser. Thus, the apparatus produces cold and stores it.

In the reverse hypothesis, i.e. when panel 10 is at a higher temperature than panel 12, as all the heat transfer fluid is in the latter, a heat transfer by heat pipe action is blocked. Thus, heat transfer can only take place by conduction. However, as is known, the extent of such a heat transfer is very limited.

The thermal connection between the storage material and the evaporator panel 12 is improved due to the presence of the coil-like pipe 16 over the entire surface of the evaporator. In an identical manner, the thermal connection between pipe 13 and the condenser panel is improved.

The apparatus can be produced by the roll bond process consisting of depositing a paint on a metal sheet by printing (rotary type as used for newspapers). Another metal sheet is then put in place and the assembly undergoes heat sealing. Accept at the points covered with the paint, diffusion moulding takes place. Thus, a pressure is produced which disengages the non-welded parts. Panels 10 and 12 can be constituted by condenser panels of the type currently used in the refrigeration industry. Thus, the apparatus costs are reduced. The overall dimensions during transportation are also reduced, which makes it possible to reduce the transportation cost.

Couplings 18 and 20 are made from a plastically deformable material, e.g. annealed aluminium or copper, which makes it possible to fold and unfold the assembly a certain number of times without any risk of leaks or fractures. The thus obtained structure is called "portfolio" compared with the structure of the prior art apparatus called "open umbrella". Thus, the transportation dimensions are reduced.

Figure 3:
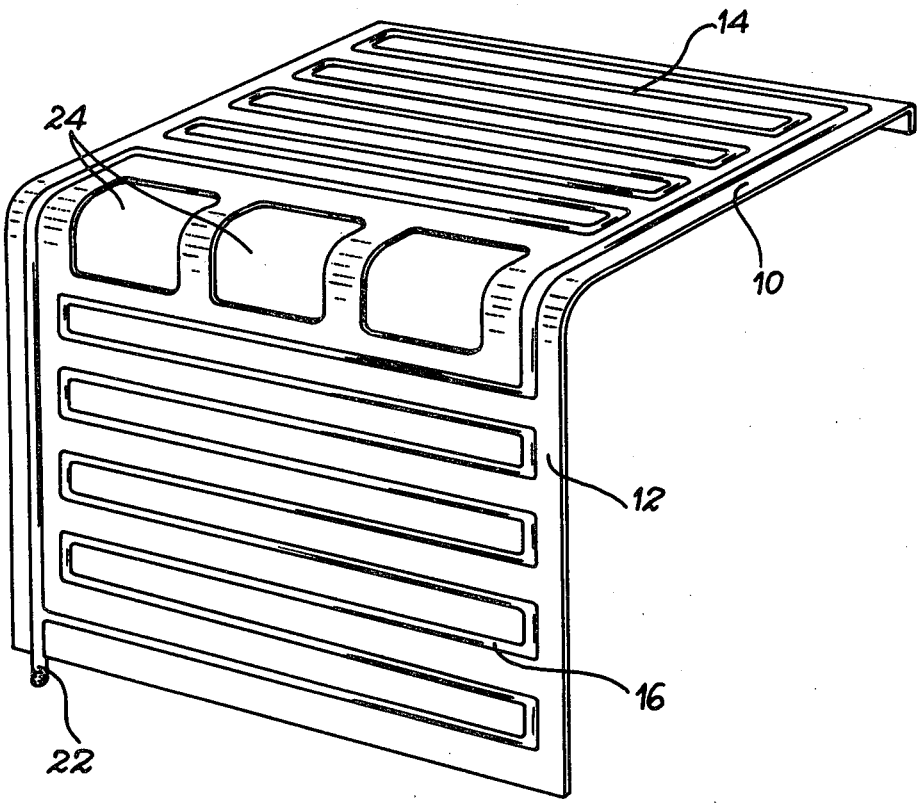

FIG. 3 shows a constructional variant of the apparatus of FIG. 2. This apparatus is constructed in the form of a single panel, which simultaneously fulfils the functions of a condenser in its upper part 10 and an evaporator in its lower part 12. Areas 10 and 12 are separated by openings 24 making it possible to thermally insulate evaporator 12 from condenser 10. Thus, the couplings 18 and 20 of the preceding embodiment are eliminated, the closed circuit carrying the heat transfer fluid being constructed in one piece. It is only then necessary to have the filling end fitting 22 for the heat transfer fluid. This panel can also be produced by the roll bond process.

This simple, inexpensive apparatus can be used over very large surface areas and it is advantageously in modular form. Such a construction is shown in FIG. 4.

Figure 4:
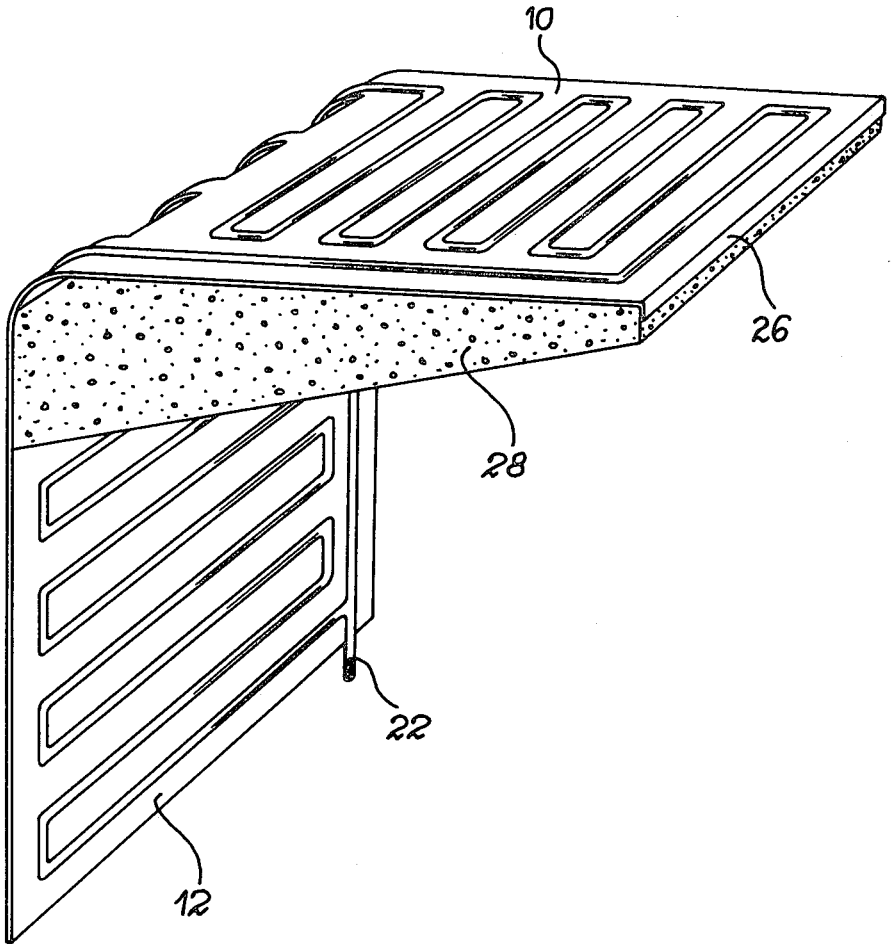
FIG. 4 a cold generation apparatus according to the invention equipped with a float.

In FIG. 4, the panel formed in one piece and described relative to FIG. 3 is attached by an edge 26 obtained by folding the end of panel 10 to a float 28. The shape of float 28, which can for example be made from expanded polystyrene, is determined in such a way that it adapts to that of the panel and gives the assembly the desired position as a function of the geographical and topographical data of the place of installation. Modular apparatus like that shown in FIG. 4 and which are all identical, but completely independent of one another can be juxtaposed to completely cover a surface which can be as large as desired.

They can be filled with a heat transfer fluid at the time of manufacture and can be either transported flat with shaping at the place of use, their belting facilitated by the internal pressure exerted by the heat transfer fluid being obtained by means of suitable tools, or after shaping at the place of manufacture by fitting them into one another.

When these panels are made from aluminium or an aluminium alloy, such as is the case when they are manufactured by the roll bond process, the radiating surface can be obtained directly and inexpensively by an anodic oxidation treatment carried out after filling with heat transfer fluid and after sealing the panel.

What is claimed is:

1. A cold generating apparatus, comprising a cold storage enclosure filled with a material having a solid-liquid transition in the vicinity of the operating temperature of the apparatus, a first condenser panel forming a radiating surface, whose radiation drops into at least one of the atmospheric windows, a substantially vertical second evaporator panel immersed in the material of the cold storage enclosure, a pipe in the form of a coil on each of the first and second panels, said pipe having an inlet and an outlet, the inlet of the pipe of each panel being connected to the outlet of the other panel by short and plastically deformable pipes, to form a closed circuit, the planes of said first and second panels forming a dihedral and a certain quantity of a fluid which is vaporizable under the operating conditions of the apparatus within the closed circuit, the assembly constituted by the first and second panels, the closed circuit and the heat transfer fluid forming a single panel device of the heat pipe type serving as a thermal diode which only transmits heat in the direction from the storage enclosure to the radiating surface and having openings in its central part which limits the heat conduction between the condenser panel and the evaporator panel.

2. A cold generating apparatus, comprising a cold storage enclosure filled with a material having a solid-liquid transition in the vicinity of the operating temperature of the apparatus, a first condenser panel forming a radiating surface, whose radiation drops into at least one of the atmospheric windows, a substantially vertical second evaporator panel immersed in the material of the cold storage enclosure, a pipe in the form of a coil on each of the first and second panels, said pipe having an inlet and an outlet, the inlet of the pipe of each panel being connected to the outlet of the other panel by short and plastically deformable pipes, to form a closed circuit, the planes of said first and second panels forming a dihedral and a certain quantity of a fluid which is vaporizable under the operating conditions of the apparatus within the closed circuit, the assembly constituted by the first and second panels, the closed circuit and the heat transfer fluid forming a device of the heat pipe type serving as a thermal diode which only transmits heat in the direction from the storage enclosure to the radiating surface and also comprising a float beneath the condenser panel and attached along an edge thereof, said float being shaped to position the apparatus in a desired position.

3. An apparatus according to claim 1, wherein plastically deformable pipes are made from an annealed metal chosen in the group containing aluminium and copper.

4. An apparatus according to claim 2, wherein said plastically deformable pipes are made from an annealed metal chosen in the group containing aluminium and copper.

* * * * *